US005810189A

United States Patent [19]

Baker

[11] Patent Number: 5,810,189

[45] Date of Patent: Sep. 22, 1998

[54] CONTAINER SEAL

[76] Inventor: Anthony Leonard Baker, Trewhiddle Lodge, Pentewan Road, St. Austell, Cornwall, United Kingdom, PL26 7AD

[21] Appl. No.: 754,209

[22] Filed: Nov. 20, 1996

[30] Foreign Application Priority Data

Nov. 22, 1995 [GB] United Kingdom ..... 9523896
Feb. 16, 1996 [GB] United Kingdom ..... 9603357

[51] Int. Cl.[6] ..... B65D 51/20

[52] U.S. Cl. ..... 220/257; 220/259; 220/269; 220/270; 220/714; 220/906

[58] Field of Search ..... 220/257, 259, 220/269, 270, 714, 906

[56] References Cited

U.S. PATENT DOCUMENTS 3,259,265 7/1966 Stuart .
3,327,891 6/1967 Smyth .
3,952,911 4/1976 Bozek et al. .
3,952,914 4/1976 Vogt .
4,083,471 4/1978 Frank .
4,215,791 8/1980 Brochman .
4,267,938 5/1981 Debenham et al. .
4,345,695 8/1982 Galloway ..... 220/254
4,361,249 11/1982 Tuneski et al. ..... 220/254
4,681,238 7/1987 Sanchez .
4,784,283 11/1988 Cantu ..... 220/269
5,096,082 3/1992 Hoefler ..... 220/257
5,143,248 9/1992 Sawatsky ..... 220/711

*Primary Examiner*—Stephen Cronin
*Attorney, Agent, or Firm*—Gifford, Krass, Groh, Sprinkle, Patmore, Anderson & Citkowski,P.C.

[57] ABSTRACT

A drinks can with a non-resealable ring pull seal includes an auxiliary sealing member supported inside the can by a leaf spring which urges it automatically to seal the opening formed on removal of the ring pull seal, the auxiliary member having an upstanding projection engageable by the user to depress the sealing member into the can for access to the contents.

17 Claims, 5 Drawing Sheets

CONTAINER SEAL

BACKGROUND OF THE INVENTION

The present invention relates to seals for containers particularly for containers such as drinks cans.

Current drinks cans often have a small opening in their flat top which is closed prior to sale by an integral tongue, or tear tab, of the can metal which is joined to the major part of the top by a line of weakness. The tongue can be torn from the can around the line of weakness by a force exerted on a metal loop, or so-called ring pull, so as either to pull the tongue from the can to remove it completely or to push it into the can where it is retained by a metal bridge between two ends of the line of weakness.

One problem with such cans is that, once the seal has been broken by tearing of the tongue, the can is no longer resealable and all the contents must be consumed fairly quickly both to avoid the risk of spillage and to avoid the loss of sparkle if the drink is carbonated because the drink will not remain palatable for long after the can has been opened. Moreover, if, as is usually the case, the drink is carbonated and the can has been shaken or warmed, the drink often spurts out of the can when it is opened.

Various ways of sealing such cans once opened are known.

U.S. Pat. No. 3,259,265, for example, discloses an auxiliary sealing member which is formed separately from the can itself but may be attached temporarily to it for sale. Once the can has been opened by tearing of the tear tab the auxiliary seal may then be detached from the can and fitted into the opening formed from the exterior. U.S. Pat. No. 4,684,238 discloses an alternative device in which the auxiliary seal is supported inside the can by the ring pull for the tear tab and is movable into its closure position, once the tab has been torn, by manual rotation of the ring pull itself.

OBJECT OF THE INVENTION

The object of the present invention is to provide an alternative auxiliary sealing device for a container having a non-reusable closure which can reseal the container opening after the closure has been removed, which is simple and economic to manufacture and which is particularly convenient in use.

BRIEF SUMMARY OF THE INVENTION

Accordingly, in one aspect, the present invention provides, in a container having a wall member defining an opening and a non-reusable closure device closing said opening, an auxiliary sealing device for reclosing and sealing said opening when said closure device has been removed, said auxiliary sealing device including a sealing member for closing said opening and forming a seal with said wall member around said opening, and support means carried by said container and supporting said sealing member therein, wherein said support means include resilient biasing means arranged to urge said sealing member towards its position of sealing engagement with said wall member such as to close said opening automatically on removal of said non-reusable closure device, said sealing member being movable away from its position of sealing engagement against the force of said resilient biasing means by a force exerted from outside said container.

The auxiliary sealing device of the invention has advantages similar to those of the device of U.S. Pat. No. 4,684,238 cited above in that it is actually attached to the container and cannot, therefore, be lost and it is located inside the container so that it cannot become contaminated. In addition, it has the advantage that it does not require manipulation to be put into operation which, in view of its relatively small size in the most common usage envisaged, that is, for drinks cans, can be awkward with some known such devices. Most importantly, however, it comes into operation immediately and automatically when the non-reusable closure is removed: it thus prevents any unwanted discharge of the contents if these are pressurised or spillage if the container is handled clumsily, particularly when full.

The sealing member may comprise a plug which is a close, possibly a resilient, fit in the opening but preferably the sealing member seals against an inner surface of the container around the opening formed by removal of the non-reusable closure device. This inner surface should therefore be clear of obstruction if the auxiliary closure device is to be simple and not too cumbersome. Current drinks cans with ring pull seals which are removable completely from the opening are therefore ideally suited to the provision of the auxiliary sealing device of the invention as, once the ring pull is removed, the can top has a simple opening surrounded, on the inside, by a generally flat surface.

Environmental concerns regarding the litter caused by the disposal of such removable ring pulls has led to the widespread use of ring pulls which remain attached to the can. The auxiliary sealing device of the invention can also be adapted for use with such cans, most conveniently with cans in which the tear tab is torn to the outside of the can so as again to leave a flat unencumbered surface inside the can against which the auxiliary sealing member can seat.

It will be appreciated that the invention is particularly applicable to drinks cans with so-called ring pull seals and reference will be made to this usage below, without thereby limiting the scope of the invention.

The auxiliary sealing device of the invention may be made at least partly integral with the can itself or may be manufactured separately and subsequently attached to the can. It may be attached so that its sealing member is normally located in a non-sealing position while the can is closed by its ring pull seal or it may be supported in a position in which the sealing member seals the opening even when the can is closed by the ring pull seal.

Various spring-biased devices using coil springs or resilient blocks may be envisaged for biasing a sealing member to close a can opening but a leaf spring is preferred for simplicity and economy of manufacture since it may conveniently serve both to bias the sealing member into its sealing position and to attach it to the can. The spring is preferably but not necessarily attached to the can wall, or top, containing the opening and may be of metal, plastics or other suitable resilient material.

The sealing member itself may, as indicated above, comprise a plug which fits into the can opening but, for simplicity, is preferably a compressible, liquid- and gas-tight washer-like member which is pressed by the biasing means against the metal surrounding the can opening. Such a washer-like member is preferably of a synthetic foam rubber.

It will be understood that, although the sealing member may normally be urged into or towards its sealing position by the resilient biasing means, it must be possible for the user to move it away from this position to gain access to the contents. The biasing force should, therefore, be sufficiently weak for the user to force the sealing member easily away from the opening, for example, with a straw or with his lip or tongue if he wishes to drink directly from the can. In a preferred embodiment of the invention the sealing member carries a stud or projection which projects through the can opening when the ring pull seal has been removed and which can be engaged by the user's lip or tongue to force the auxiliary sealing member into the can when the user wishes to drink.

In another aspect, the invention provides a drinks can having a peripheral wall and an end wall member sealed to said peripheral wall and defining an opening, a non-reusable closure device closing said opening and an auxiliary sealing device for reclosing and sealing said opening when said closure device has been removed, said auxiliary sealing device including a sealing member for closing said opening and forming a seal with said wall member around said opening and support means carried by said drinks can and supporting said sealing member therein, wherein said support means include resilient biasing means arranged to urge said sealing member towards its position of sealing engagement with said wall member such as to close said opening automatically on removal of said non-reusable closure device, said sealing member being movable away from its position of sealing engagement against the force of said resilient biasing means by a force exerted from outside said container.

Several embodiments of the invention will now be more particularly described by way of example with reference to the accompanying drawings, which are briefly described below.

DETAILED DESCRIPTION OF THE PREFERRED EMBODIMENTS

Figure 1:
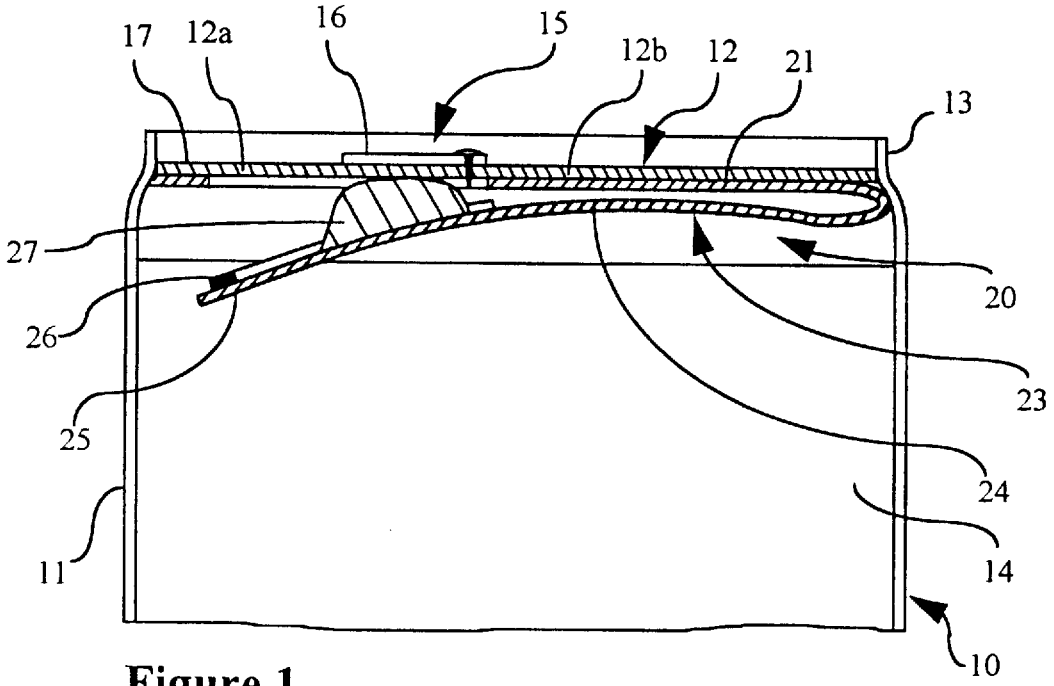
FIG. 1 is a vertical sectional view through a drinks can fitted with an auxiliary sealing device of the invention with its ring pull seal still intact.
Figure 2:
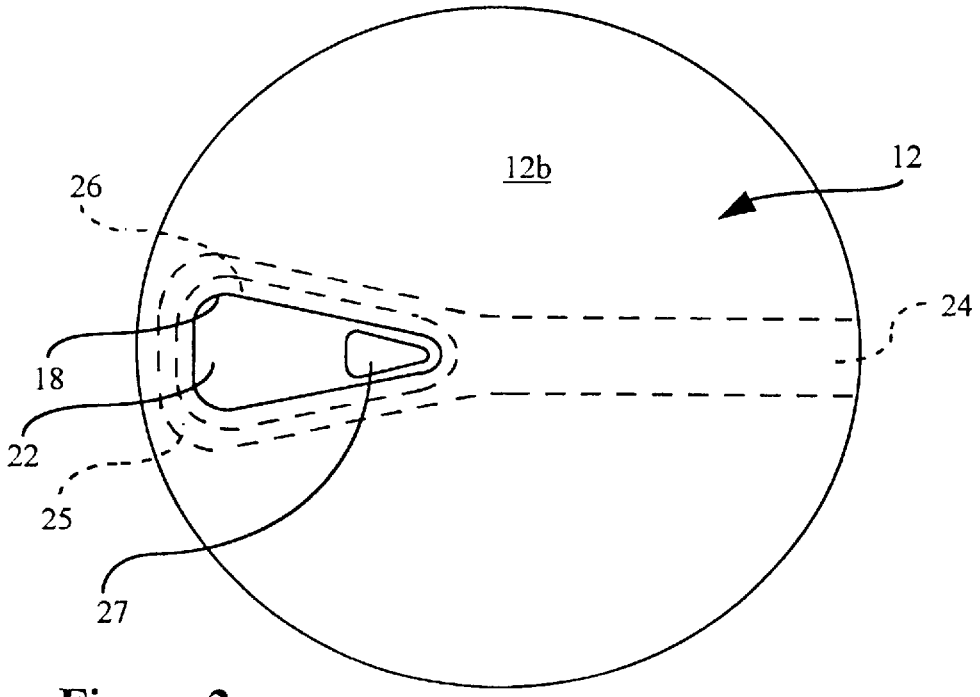
FIG. 2 is top plan view of the can of FIG. 1 with its ring pull seal removed, on a smaller scale.
Figure 3:
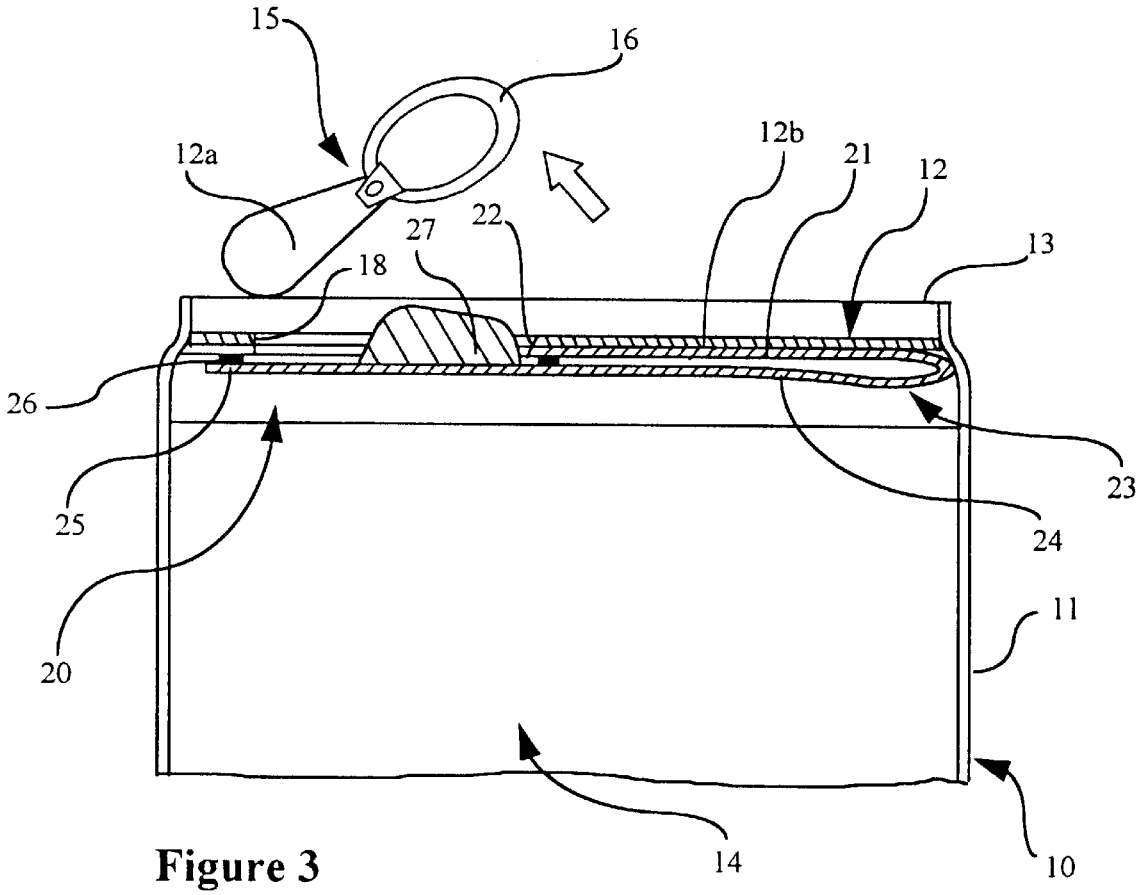
FIG. 3 is a view similar to FIG. 1 showing the can with its ring pull seal removed.

With reference to FIGS. 1 to 3 of the drawings, a drinks can shown generally indicated 10 comprises, in known manner, a cylindrical wall 11 closed at each end by respective top and bottom circular metal sheets, only the top sheet 12 of which is shown. The top 12 is sealed to the wall 11 in any known manner and is shown surrounded by an upstanding rim 13 of the cylindrical wall 11. The can 10 is of such a construction that it can contain a carbonated drink 14, the can 11 being filled and the top 12 being applied and sealed to the wall 11 under pressure.

The can 11 is openable by means of a known ring pull closure device or seal 15 comprising a finger ring 16 attached to one end of a generally trapezoidal-shaped tongue 12*a* forming an integral part of the top 12 but joined to the remaining part of the top 12 by a line of weakness 17. When the ring 16 is pulled, the top 12 tears along the line 17 so that the tongue 12*a* becomes detached and leaves an opening 18 (FIGS. 2 and 3) through which the drink 14 can be withdrawn.

The can 10 further includes a spring-biased sealing device generally indicated 20 for sealing the opening 18 after the tongue 12*a* has been removed. The device 20 includes a circular support plate 21 which is attached to the inner surface of the top 12 of the can 10 and has an opening 22 the periphery of which is of the same size and shape as the tear line 17 and which is located in correspondence with the latter.

The support plate 21 carries a leaf spring 23 comprising an elongate resilient blade 24 attached to the plate 21 adjacent the periphery of the can 10 and extending generally diametrally across the can 10 close beneath the plate 21. The blade 24 terminates in a generally trapezoidal flat blade portion 25 of such a size that it extends fully across the opening 22.

The flat blade portion 25 carries an annular synthetic-foam sealing member 26 on its upper face facing the support plate 21. The sealing member 26 is of the same peripheral shape as the opening 22 but of a slightly larger size such that it can seat against the part of the plate 21 surrounding the opening 22 to form a seal between the interior of the can 10 and the plate 21.

The trapezoidal blade portion 25 also carries a stud 27 on the same surface as the sealing member 26 and inside it. When the can 10 is closed, with its top 12 intact, the stud 27 contacts the underside, or inner surface, of the tongue 12*a* and prevents the sealing member 26 from contacting the support plate 21, as shown in FIG. 1. In this condition the leaf spring 23 is stressed and urges the trapezoidal blade portion 25 towards the support plate 21. When the tongue 12*a* is removed by means of the ring 16, the leaf spring 23 is able to press the sealing member 26 against its support plate 21, sealing the opening 22 and hence the can opening 18. This situation is shown in FIGS. 2 and 3.

When the user of the can 10 wishes to drink from it, he can press the trapezoidal blade portion 15 into the can 10 so as to unseal the opening 18 either with the aid of implement, such as a straw, or by pressing the stud 27 with his upper lip. After sufficient drink has been withdrawn, he may then remove the pressure on the blade portion 25 at which time the leaf spring 23 will return the sealing member 26 into sealing contact with its support plate 21 to retain any remaining drink in the can. The drink will thus be sealed from the air and will remain palatable for far longer than is usual with such drinks cans. The immediate sealing of the opening 18 when the ring pull closure 15 is removed also helps reduce any spurt of liquid that occurs on opening of the can 10.

In the embodiment shown in FIGS. 1 to 3 of the drawings, the sealing device 20 is shown attached to the can top 12 by means of its support plate 21 but the support plate 21 may be omitted, the leaf spring 23 being attached directly to the top 12, possibly being formed integrally with it.

A separate sealing device 20 may be made of the same material as the can 10 or of a different material and may be attached to the can 10 by any suitable method, such as gluing, welding, rivetting or other known technique.

Figure 5:
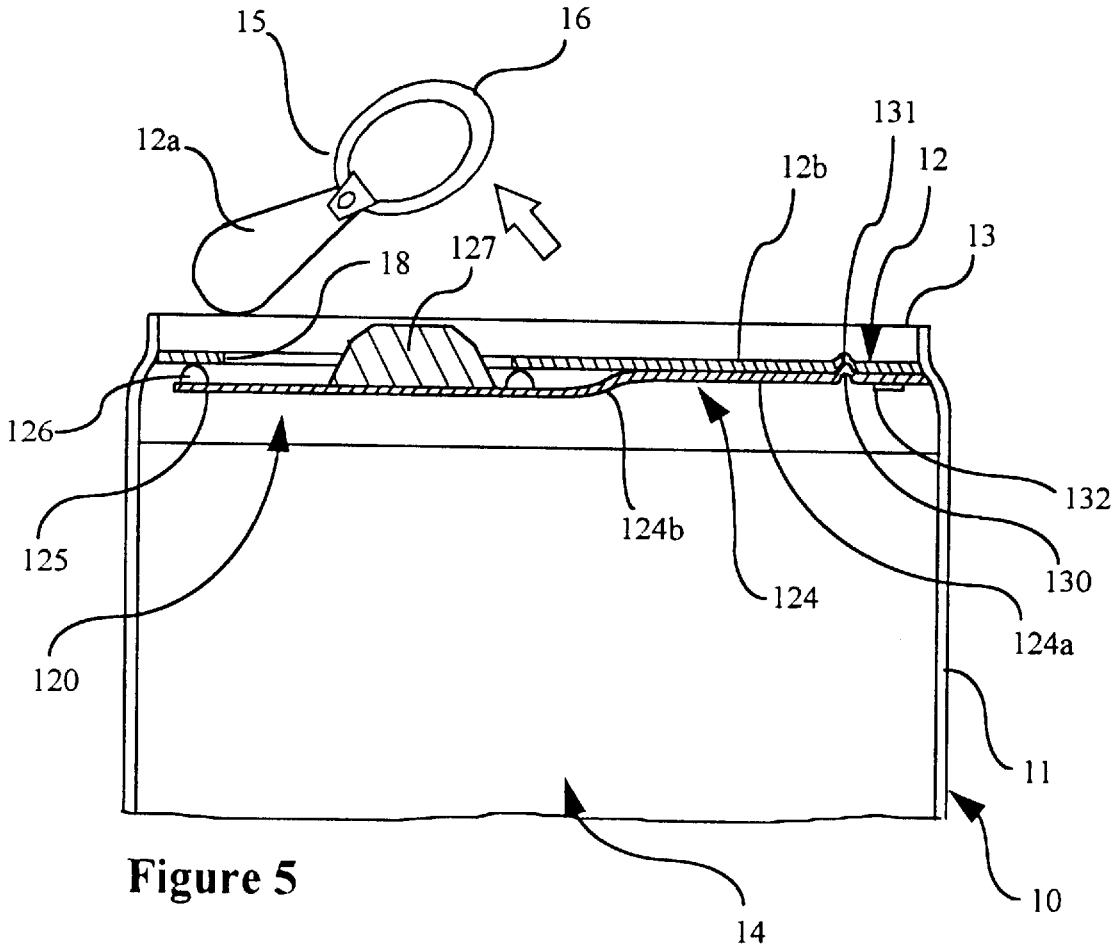
FIG. 5 is a sectional view similar to FIG. 3 showing the embodiment of FIG. 4.
Figure 4:
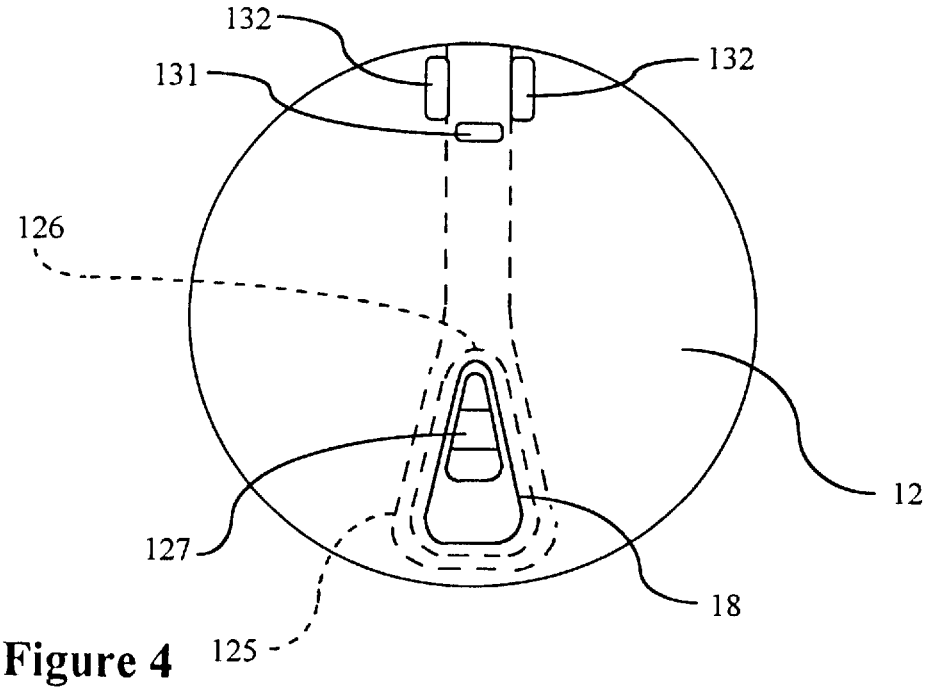
FIG. 4 is a top plan view similar to FIG. 2 showing a second embodiment of a drinks can fitted with an auxiliary sealing device of the invention.

With reference to FIGS. 4 and 5 of the drawings, a drinks can 10 is shown which is similar to that of FIGS. 1 to 3 but is fitted with a variant spring-biased sealing device generally indicated 120. Parts of the can 10 are indicated by the same reference numerals as in FIGS. 1 to 3 while parts of the sealing device 120 similar to those of FIGS. 1 to 3 are indicated by the same references increased by 100 and will not be described again.

The main difference between the sealing device 120 and the device 20 of FIGS. 1 to 3 lies in its mode of attachment to the can top 12. The elongate resilient blade 124 which at one end carries the trapezoidal portion 125 with the annular sealing member 126 is attached directly to the can top 12 at its other end rather than being supported by the plate 21 of FIG. 1.

To this end the blade 124 has a small projection or lug 130 on its surface facing the top 12 adjacent its end remote from the sealing member 126. This projection 130 is a snap fit in a cooperating recess 131 in the facing inner surface of the top 12. In addition the top 12 has two counter-lugs 132 close to the recess 131 and projecting from its inner surface for snap-engaging on opposite sides of the blade 124. The projections or lugs 130, 132 and recess 131 are preferably made by pressing from the metal constituting the top 12 and the blade 124 as appropriate. Clearly the top 12 and blade 124 could be formed with alternative arrangements of snap-engageable projections and recesses to attach the blade 124 to the top 12, or the end of the blade could be attached to the peripheral wall of the can.

Figure 6:
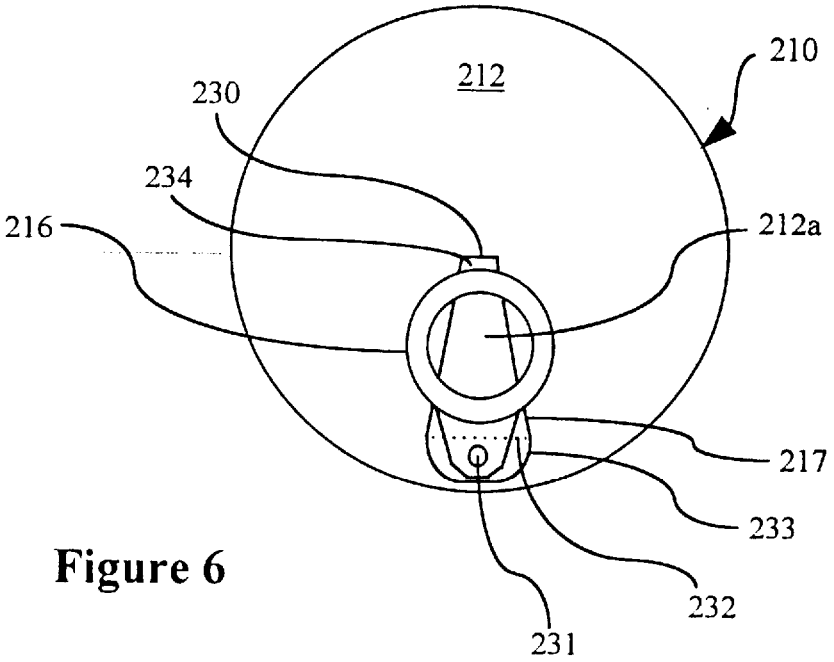
FIG. 6 is a top plan view of a drinks can according to a further embodiment of the invention with a ring pull closure sealing the can.

A further variation in the embodiment of FIGS. 5 and 6 is the shaping of the blade 124 itself. The blade 124 includes an end portion 124*a* connected by an elbow portion 124*b* to the trapezoidal portion 125. The elbow portion 124*b* supports the trapezoidal portion 125 spaced slightly from the top 12 in such a manner that, when the sealing member 126 is in its sealing position as shown in FIG. 5, the sealing member 126 is pressed firmly and evenly against the top 12 around the entire periphery of the opening 18 and stud 127 extends upwardly in the same fashion as stud 27 illustrated in the first embodiment.

Figure 7:
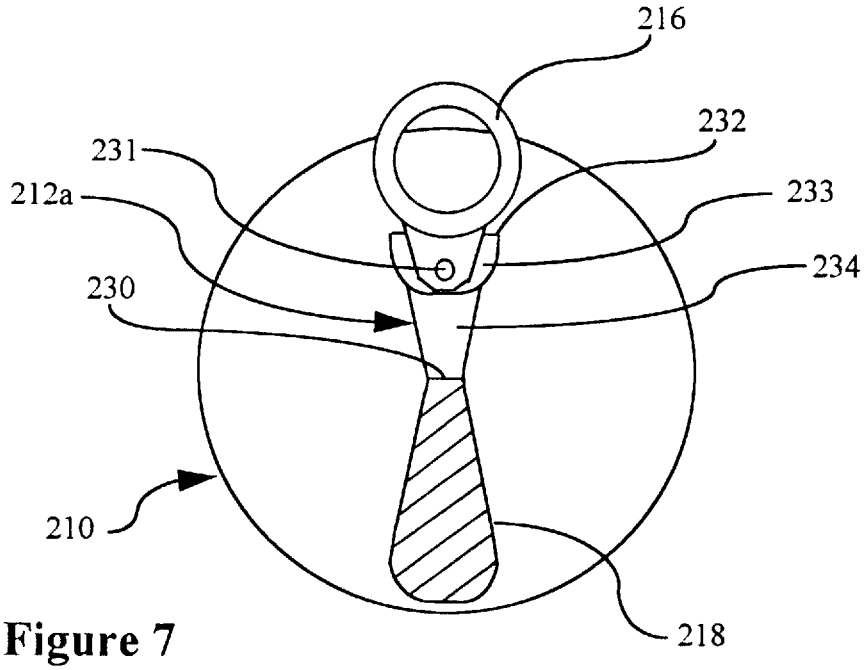
FIG. 7 is a view similar to FIG. 6 but with the ring pull seal broken.

With reference now to FIGS. 6 to 8 of the drawings, these show a drinks can 210 with an alternative ring pull closure and an auxiliary sealing device similar to that described above in relation to FIGS. 1 to 3 but which could equally well be fitted with the sealing device of FIGS. 4 and 5. Features of the can 210 of FIGS. 6 to 8 which are similar to those of the can 10 of FIGS. 1 to 3 are indicated by the same references increased by 200 and will not be described in detail. The sealing device 220 is not shown in FIGS. 8*a*–8*e* for clarity of illustration.

In the embodiment of FIGS. 6 to 8 the trapezoidal tongue 212*a* of the ring-pull closure device 215 is joined to the top 212 by a line of weakness 217 but this has a discontinuity 230 along the shorter base of the trapezium which is located generally centrally of the container top 212. The finger ring 216 is attached to the tongue 212*a* by a rivet 231 close to the larger base of the trapezium which is located close to the periphery of the top 212.

The tongue 212*a* has an additional line of weakness 232 which extends transverse the length of the tongue 212*a*, between the rivet 231 and the central, shorter base 230 of the trapezium but close to the rivet 231. The line 232 divides the tongue 212*a* into two parts, a smaller portion 233 carrying the ring 216 attached by the rivet 232 and a larger portion 234 extending to the discontinuity 230.

Figure 8A:
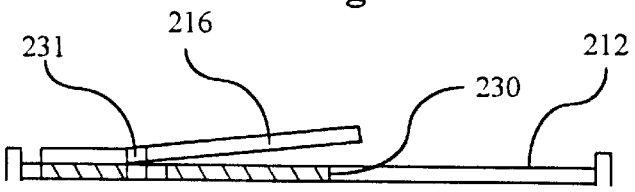
FIGS. 8*a*–8*e* show steps in the breaking of the ring pull seal of FIG. 6 in schematic side elevation.
Figure 8B:
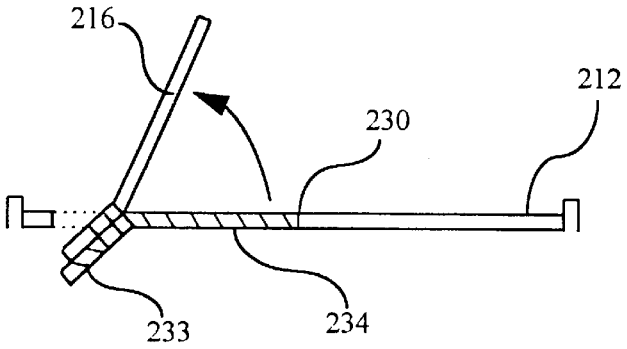
Figure 8C:
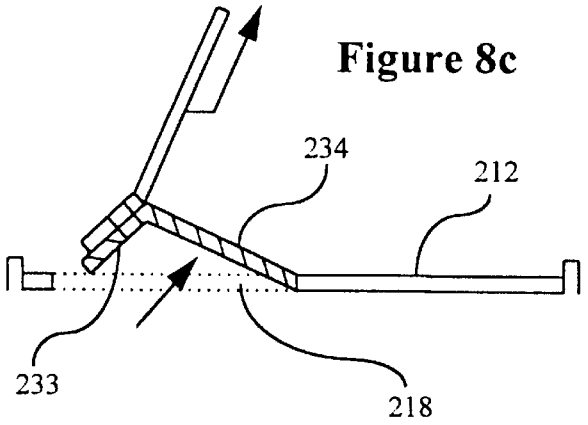
Figure 8D:
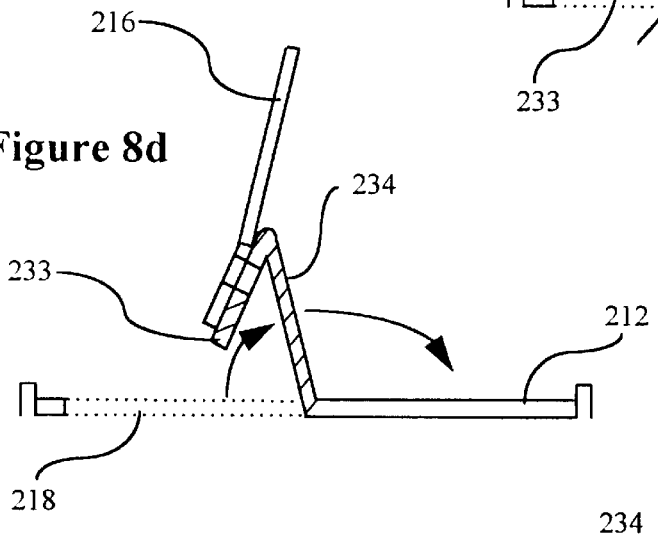
Figure 8E:
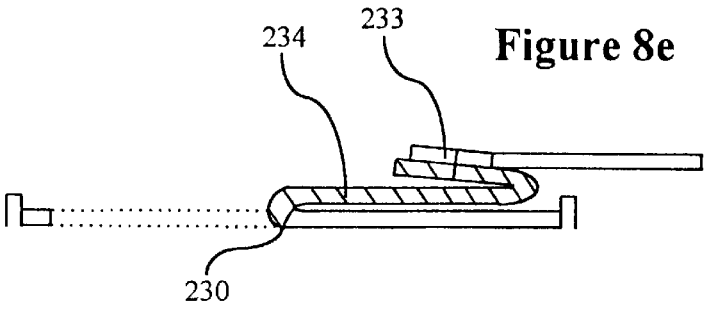

The line of weakness 232 comprises a fold line such that, when the ring 216 is lifted from the position shown in FIG. 8*a* to that shown in FIG. 8*b*, the ring attachment at the rivet 231 forces the smaller portion 233 of the tongue 212*a* into the can 210, the tearline 217 tearing along the periphery of this smaller portion 233. From this position, FIG. 8*b*, the ring can then be pulled upwardly to continue the tearing along the remainder of the tear line 217 as shown in FIG. 8*c*.

When the tears along the two longer sides of the trapezium reach the discontinuity 230, tearing stops and the tongue 212*a* can be folded right back, the metal bending along the discontinuity 230 constituting the shorter base of the trapezium. The tongue can be bent through the position of FIG. 8*d* to that of FIG. 8*e*, also shown in FIG. 7, in which the major portion 234 of the tongue rests against the top 212.

It will be apparent that the tongue 212*a* remains attached to the can 210 along the line 230 but is outside the can so that an auxiliary sealing device 220 fitted inside the can operate to seal the opening 218 in the manner described in relation to FIGS. 1 to 4.

What is claimed is:

1. In a container having a wall member defining an opening and a non-reusable closure device closing said opening, an auxiliary sealing device for reclosing and sealing said opening when said closure device has been removed, said auxiliary sealing device including resiliently compressible annular a sealing member for closing said opening and forming a seal with said wall member around said opening and support means carried by said container and supporting said sealing member therein, wherein said support means include resilient biasing means arranged to urge said sealing member towards its position of sealing engagement with said wall member such as to close said opening automatically on removal of said non-reusable closure device, said sealing member being movable away from its position of sealing engagement against the force of said resilient biasing means by a force exerted from outside said container.

2. The container as claimed in claim 1, wherein said support means are carried by said container wall member.

3. The container as claimed in claim 1, wherein said auxiliary sealing member carries a projection in such a position as to project through said container opening when said non-reusable closure device has been removed and said opening is sealed by said sealing member, said projection being engageable by a user of said container to move said sealing member away from said position of sealing engagement.

4. The container as claimed in claim 1, wherein said resilient means comprise a leaf spring having a first end supported by said container and a second end opposite said first end carrying said sealing member.

5. The container as claimed in claim 4, wherein said first end of said leaf spring and said container have mutually snap-engaged formations, whereby said leaf spring is supported by said container.

6. In a container having a wall member defining an opening and a non-reusable closure device for closing said opening, an auxiliary sealing device for reclosing and sealing said opening when said closure device has been removed, said auxiliary sealing device including a resiliently compressible annular sealing member for closing said opening and forming a seal with said wall member around said opening and support means carried by said container and supporting said sealing member therein, wherein said support means include resilient biasing means arranged to urge said sealing member towards its position of sealing engagement with said wall member such as to close said opening automatically on removal of said non-reusable closure device, said sealing member being movable away from its position of sealing engagement against the force of said resilient biasing means by a force exerted from outside said container, and wherein said auxiliary sealing member carries a projection in such a position as to project through said container opening when said non-reusable closure device has been removed and said opening is sealed by said sealing member, said projection being enagageable by a user of said container to move said sealing member away from said position of sealing engagement.

7. The container as claimed in claim 6, wherein said support means are carried by said container wall member.

8. The container as claimed in claim 6, wherein said resilient means comprise a leaf spring having a first end supported by said container and a second end opposite said first end carrying said sealing member.

9. The container as claimed in claim 6, wherein said auxiliary sealing member includes a resiliently compressible annular member for forming said sealing with said wall member.

10. The container as claimed in claim 6, wherein said first end of said leaf spring and said container have mutually snap-engaged formations, whereby said leaf spring is supported by said container.

11. The drink can as claimed in claim 10, wherein said auxiliary sealing member includes a resiliently compressible annular member for forming said seal with said wall member.

12. A drink can having a peripheral wall and an end wall member sealed to said peripheral wall and defining an opening, a non-reusable closure device closing said opening and auxiliary sealing device for reclosing and sealing said opening when said closure device has been removed, said auxiliary sealing device including a sealing member for closing said opening and forming a seal with said end wall member around said opening and support means carried by said drink can and supporting said sealing member therein, wherein said support means include resilient biasing means arranged to urge said sealing member towards its position of sealing engagement with said end wall member such as to close said opening automatically on removal of said non-reusable closure device, said sealing member being movable away from its position of sealing engagement against the force of said resilient biasing means by a force exerted from outside said container, and wherein said auxiliary sealing member carries a projection in such a position as to project through said opening when said non-reusable closure device has been removed and said opening is sealed by said sealing member, said projection being engageable by a user of said container to move said sealing member away from said position of sealing engagement.

13. The container as claimed in claim 12, wherein said resilient means comprise a leaf spring having a first end supported by said can and a second end opposite said first end carrying said sealing member.

14. The drinks can as claimed in claim 12, wherein said first end of said leaf spring and said drinks can have mutually snap-engaged formations, whereby said leaf spring is supported by said can.

15. The drink can as claimed in claim 12, wherein said support means are carried by said container wall member.

16. The drink can as claimed in claim 12, wherein said resilient means comprise a leaf spring having a first end supported by said container and a second end opposite said first end carrying said sealing member.

17. The drink can as claimed in claim 12, wherein said first end of said leaf spring and said container have mutually engaged formations, whereby said leaf spring is supported by said container.

* * * * *